US006334709B1

(12) United States Patent
Bois

(10) Patent No.: US 6,334,709 B1
(45) Date of Patent: Jan. 1, 2002

(54) STACK OF BAGS HAVING CURSORS INITIALED POSITIONED OFFSET FROM EACH OTHER

(75) Inventor: Henri Georges Bois, Neuilly-sur-Seine (FR)

(73) Assignee: Flexico-France, Henonville (FR)

( * ) Notice: Subject to any disclaimer, the term of this patent is extended or adjusted under 35 U.S.C. 154(b) by 0 days.

(21) Appl. No.: 09/463,411

(22) PCT Filed: Jun. 1, 1999

(86) PCT No.: PCT/FR99/01281

§ 371 Date: Mar. 22, 2000

§ 102(e) Date: Mar. 22, 2000

(87) PCT Pub. No.: WO99/62780

PCT Pub. Date: Dec. 9, 1999

(30) Foreign Application Priority Data

Jun. 3, 1998 (FR) ..... 98 06956

(51) Int. Cl.[7] ..... B65D 30/00

(52) U.S. Cl. ..... 383/37; 383/32; 383/64; 493/213; 206/820

(58) Field of Search ..... 383/37, 64, 32; 206/554, 820, 390; 493/213, 214, 212; 53/571

(56) References Cited

U.S. PATENT DOCUMENTS

| | | | | |
|---|---|---|---|---|
| 3,417,864 A | | 12/1968 | Paxton | |
| 3,446,344 A | | 5/1969 | Paxton | |
| 3,701,191 A | * | 10/1972 | Laguerre | |
| 3,790,992 A | * | 2/1974 | Herz | 383/64 X |
| 3,915,302 A | | 10/1975 | Farrelly et al. | |
| 4,416,376 A | | 11/1983 | Scheffers et al. | |
| 4,523,918 A | * | 6/1985 | Ausnit | 493/215 X |
| 4,581,006 A | * | 4/1986 | Hugues et al. | |
| 4,584,706 A | * | 4/1986 | Ausnit | 358/37 |
| 4,768,327 A | * | 9/1988 | Mosher | |
| 4,798,041 A | * | 1/1989 | Bentsen | |
| 4,844,256 A | * | 7/1989 | Honegger | 206/390 |
| 5,022,523 A | * | 6/1991 | Honegger | 206/390 |
| 5,071,689 A | * | 12/1991 | Tilman | 383/32 X |
| 5,155,967 A | * | 10/1992 | Branson | |
| 5,383,989 A | * | 1/1995 | McMahon | 383/37 X |
| 5,482,375 A | * | 1/1996 | Richardson et al. | 383/64 |
| 5,682,730 A | | 11/1997 | Dobreski | |
| 5,718,337 A | * | 2/1998 | Carr et al. | |
| 5,776,045 A | * | 7/1998 | Bodolay et al. | 493/213 X |

FOREIGN PATENT DOCUMENTS

| | | | |
|---|---|---|---|
| EP | 0 051 010 | | 5/1982 |
| EP | 0 102 301 | | 3/1984 |
| EP | 0424718 | A1 * | 10/1990 |
| EP | 0 479 661 | | 4/1992 |
| WO | WO 00/67602 | * | 11/2000 |

* cited by examiner

*Primary Examiner*—Allan N. Shoap
*Assistant Examiner*—Robin A. Hylton
(74) *Attorney, Agent, or Firm*—Jacobson Holman, PLLC

(57) ABSTRACT

A set of at least three consecutive bags in a succession, each bag having two closure strips and a cursor situated at a respective distance ($d_1$, $d_2$) from one end of the strips, the strips and the cursor being identical between the bags. Between the bags in each pair of adjacent bags, the distances ($d_1$, $d_2$) are different.

5 Claims, 2 Drawing Sheets

STACK OF BAGS HAVING CURSORS INITIALED POSITIONED OFFSET FROM EACH OTHER

The invention relates to bags that are reclosable by means of closure strips, and to the manufacture thereof.

Methods are known for manufacturing bags out of plastics material in which each bag opening has two closure strips and a cursor that slides thereon. During manufacture, the cursor is situated at a predetermined distance from the ends of the strips so as to avoid interfering with the heat-sealing and cutting operations that are performed. However, when the bags are placed one on another, the cursors pile up against one another, thereby generating a stack whose height is much greater at the cursors than over the remainder of the bags. Thus, storage of the bags is complicated by the volume of such stacks and by their instability. In particular, it is difficult to make up rolls or stacks having a large number of bags.

Document U.S. Pat. No. 5,682,730 discloses a stack of bags having a lower series of successive bags in which said distance has a first constant value such that the cursors are stacked one on another close to one end of the strips, and an upper series of successive bags in which said distance has a second constant value, different from the first value, with the cursors of said second series being stacked one on another at the other end of the strips. In this way, the two stacks of cursors do not interfere with each other and both of them occupy almost the same height, thereby greatly reducing the total height of the stack. That disposition is made possible because the bags are flexible. Nevertheless, the height of the stack of bags remains relatively large.

An object of the invention is to improve storage of bags, in particular for the purpose of making rolls or stacks of very large numbers of bags.

According to the invention, this object is achieved by a set of at least three consecutive bags in a succession, each bag having two closure strips and a cursor situated at a respective distance from one end of the strips, the strips and the cursor being identical between the bags, and in which, between the bags in each pair of adjacent bags, the said distances are different.

Thus, a disposition of the cursors is obtained which differs from the above-mentioned known disposition and which makes it possible to store the bags in a volume that is different and more stable, and for example in a stack that is of smaller height. For example, the cursors can be relatively offset by half the length of a cursor. Under such circumstances, stacking the bags causes the strips to be twisted slightly, and causes the cursors that lie one on another to be inclined. This reduces the volume of the stack at the cursors.

Preferably, the said distances differ by not less than the size of the cursors parallel to the strips.

In this way, the bags can be stacked one on another with the strips being contiguous but without the stacked cursors interfering with one another, the cursors being disposed next to one another. Under such circumstances, the volume of the set of bags corresponds substantially to that generated by the walls and the strips, and is therefore considerably reduced. As a result, the stack of bags is stable.

Advantageously, the said distances on adjacent bags vary in a monotonic progression.

It is thus possible to stack a very large number of bags while optimizing the volume available for the cursors without risking interference, even between cursors of bags that are not consecutive.

Advantageously, the said distances vary by an increment that is constant.

Advantageously, the bags are disposed so that their strips are contiguous.

Advantageously, the set constitutes a roll of bags.

Advantageously, the set constitutes a stack of bags.

The invention also provides a method of manufacturing at least three bags each having two closure strips and a cursor, the strips and the cursors being identical between the bags, in which each cursor is disposed at a respective distance from one end of the strips, and in which the cursors are disposed in such a manner that the said distances are different between any two successive bags.

The invention also provides an installation for manufacturing bags each including two closure strips and a cursor, the installation comprising means for placing each cursor at a respective distance from one end of the strips, in which the means are organized to place the cursors of any two successive bags at distances that are different.

Other characteristics and advantages of the invention will appear further on reading the following description of a preferred embodiment given by way of non-limiting example. In the accompanying drawings.

Figure 1:
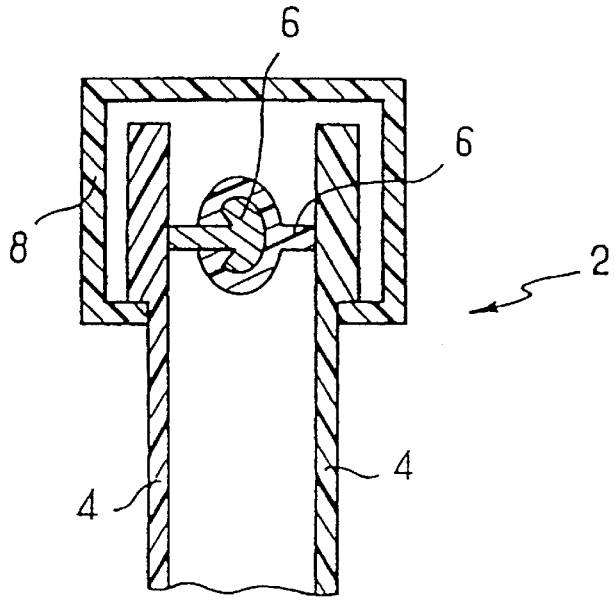
FIG. 1 is a fragmentary view of a bag in crosssection through its closure strips.
Figure 2:
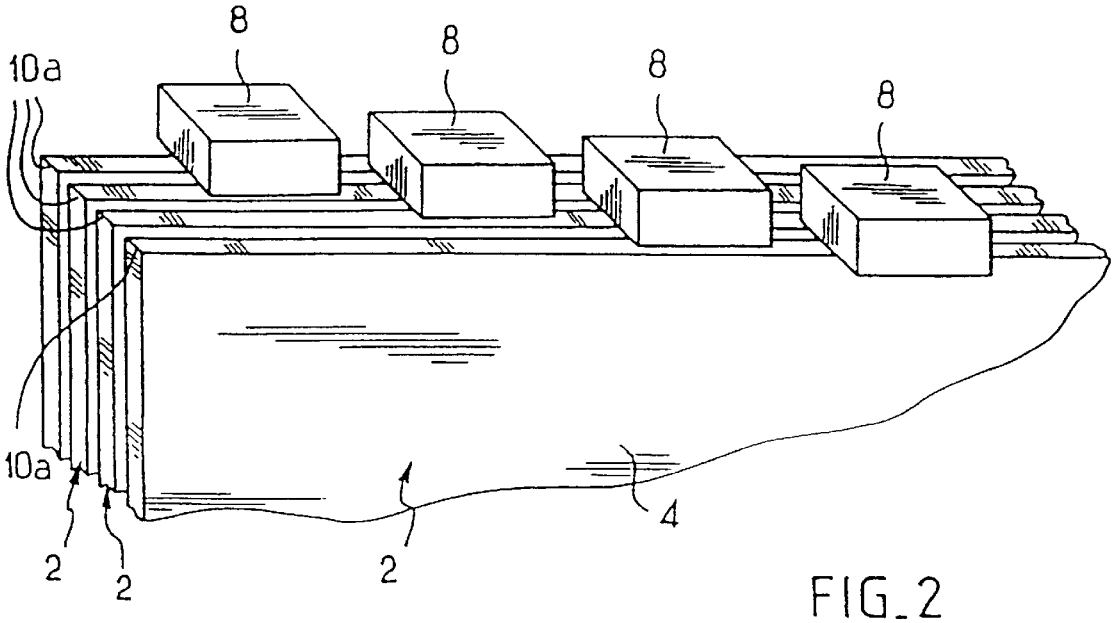
FIG. 2 is a perspective view showing how the cursors of a plurality of bags in a set are positioned.

With reference to FIG. 1, the invention applies to identical bags 2 of a type that is known Per se. The bag 2 of plastics material has two rectangular plane walls 4 placed side by side and bonded together via three of their edges so as to constitute a bag proper. The unbonded sides form an opening and receive complementary rectilinear closure strips 6 on their inside faces to constitute a releasable leakproof closure. A cursor 8 is slidably mounted on the strips 6 and is shaped (in a manner that is not shown but that is known per se) so that sliding in one direction causes the strips 6 to be associated with each other so as to close the bag 2, while sliding in the opposite direction separates the strips so as to open the bag.

Figure 5:
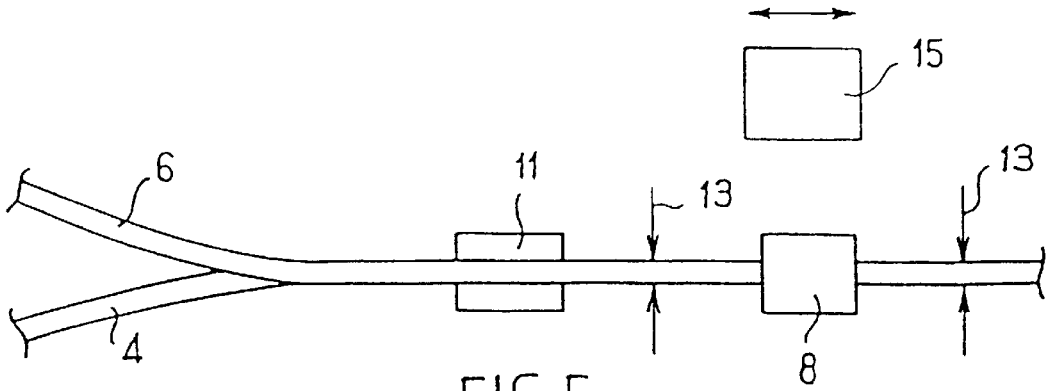
FIG. 5 is a diagrammatic view of an installation of the invention.

With reference to FIG. 5, in the method of the invention for manufacturing bags, the bags 2 are formed from a contiguous membrane 4 and the strips 6 are applied and bonded to the bags continuously at a station 11, before or after the membrane is cut up into individual bags. When the strips 6 are put into place, they can already carry one cursor 8 for each bag, or else the cursors 8 can be fitted after the strips 6 have been placed on the bags. Manufacture includes a step of heat-sealing the ends 10*a*, 10*b* of the strips 6 to each other and of cutting the strips in a station 13, which operation may take place simultaneously with the step of cutting the bags apart from one another.

Figure 3:
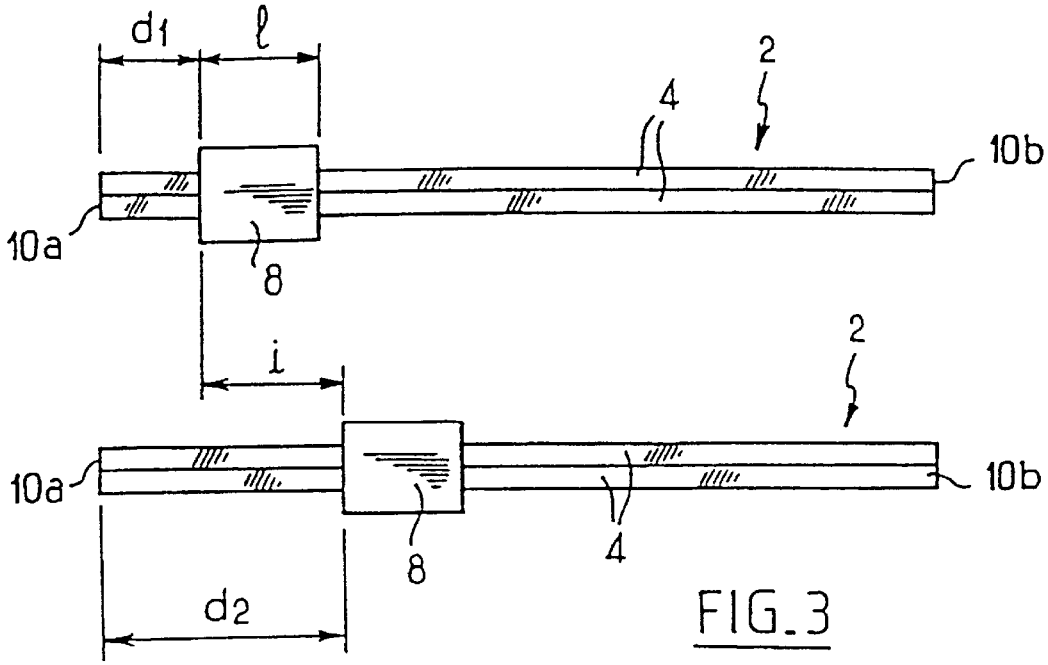
FIG. 3 is an end view of two bags in FIG. 2.
Figure 4:
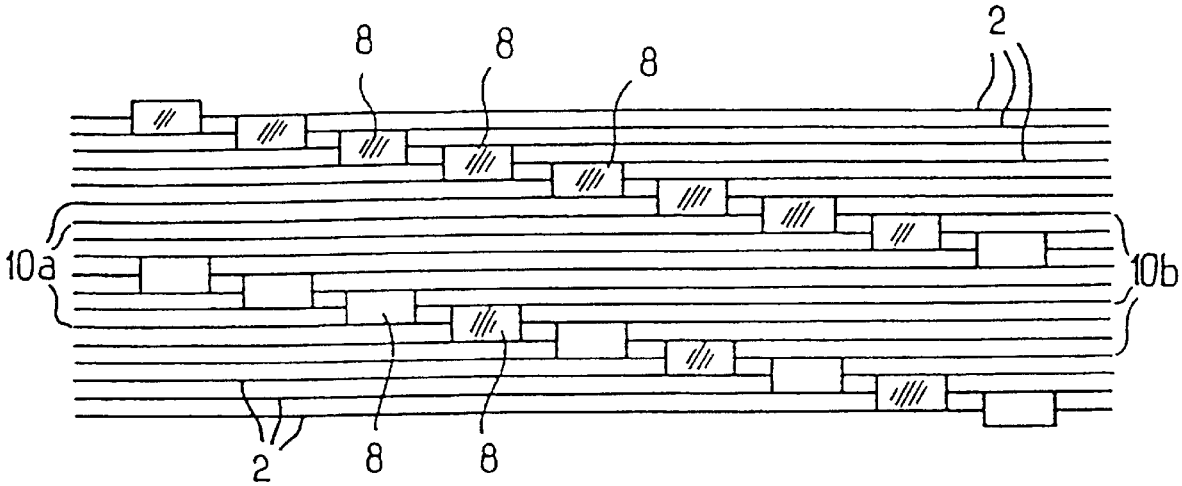
FIG. 4 is an end view of a stack comprising a large number of bags.

At some stage during manufacture, after the cursor 8 has been put into place, e.g. while the strips 6 are being cut, a positioning device 15 is programmed to slide the cursor 8 of each bag along the strips and to place it at a predetermined distance $d_1$, $d_2$ from one of the ends 10*a* of the strips. This distance $d_1$, $d_2$ is designed so as to be different for any two successive bags 2 during manufacture. Specifically, and with reference to FIG. 3, the difference between $d_1$ and $d_2$ is an increment i greater than the length l of the cursor 8 parallel to the strips 6. In addition, for a given series of bags 2, e.g.

a series of nine bags as shown in FIG. 4, the distance d is caused to vary monotonically, i.e. it decreases only or it increases only (as in this case) on going from one bag to the next in the series. The increment i between bags 2 is constant in this case. Care is preferably taken to ensure that the value of the increment i is only slightly greater than the length l of a cursor 8, and in particular is less than 2×l, e.g. being equal to 1.5×l so as to ensure that the largest possible number of bags can be included in the same series before reaching the other end 10*b* of the strips.

At the end of such manufacture, bags 2 are obtained whose cursors 8 are at respective different above-specified distances $d_1$, $d_2$. The bags 2 can thus be rolled up and stacked by causing the respective ends 10*a* and 10*b* of the strips 6 to coincide without giving rise to mutual interference between the cursors 8 within a given series of bags, or indeed between successive series of bags, such as the two series of nine bags each shown in FIG. 4.

What is claimed is:

1. A set of at least three consecutive bags in stacked succession, each bag having two closure strips and a cursor slidably mounted on said two closure strips, said cursor being situated at a respective distance from one end of the strips, the strips and the cursor being identical between the bags, and said respective distance of said cursor from said one end of the strips for every two adjacent bags of said at least three consecutive bags being different.

2. A set according to claim 1, wherein the distances from said one end of the bags differ by not less than a size of the cursors parallel to the strips.

3. A set according to claim 1, wherein the distance on adjacent bags vary in a monotonic progression.

4. A set according to claim 1, wherein the distances vary by an increment that is constant.

5. A set according to claim 1, wherein the set constitutes a stack of bags.

* * * * *